US011017910B2

(12) United States Patent
Moyaux et al.

(10) Patent No.: US 11,017,910 B2
(45) Date of Patent: May 25, 2021

(54) METHOD FOR PRODUCING AN IODINE RADIOISOTOPES FRACTION, IN PARTICULAR OF I-131, IODINE RADIOISOTOPES FRACTION, IN PARTICULAR OF I-131

(71) Applicant: INSTITUT NATIONAL DES RADIOÉLÉMENTS, Fleurus (BE)

(72) Inventors: Dominique Moyaux, Court-Saint-Etienne (BE); Valery Host, Ohey (BE); Caroline Decamp, Longueville (BE)

(73) Assignee: INSTITUT NATIONAL DES RADIOÉLÉMENTS, Fleurus (BE)

( * ) Notice: Subject to any disclaimer, the term of this patent is extended or adjusted under 35 U.S.C. 154(b) by 153 days.

(21) Appl. No.: 16/312,963

(22) PCT Filed: Jun. 28, 2017

(86) PCT No.: PCT/EP2017/065974
§ 371 (c)(1),
(2) Date: Dec. 21, 2018

(87) PCT Pub. No.: WO2018/002127
PCT Pub. Date: Jan. 4, 2018

(65) Prior Publication Data

US 2019/0228870 A1 Jul. 25, 2019

(30) Foreign Application Priority Data

Jun. 28, 2016 (BE) ..... 2016/5495

(51) Int. Cl.
*G21G 1/00* (2006.01)

(52) U.S. Cl.
CPC ..... *G21G 1/001* (2013.01); *G21G 2001/0063* (2013.01)

(58) Field of Classification Search
CPC ..... G21G 1/00; G21G 2001/0063
See application file for complete search history.

(56) References Cited

PUBLICATIONS

J. Salacz, Reprocessing of irradiated Uranium 235 for the production of Mo-99, i-131, Xe-133 radioisotopes, Revue, IRE Tijdschritt, vol. 9(3). (Year: 1985).*
A. Mushtaq et al. Preparation and characterization of silver coated alumina for isolation of iodine-131 from fission products. Journal of Engineering and Manufacturing Tech. 2, 1-9. (Year: 2014).*
A. Mushtaq et al., Preparation and characterization of siliver coated alumina for isolation of iodine-131 from fission products, JEMT, 1., 1-9. (Year: 2014).*
International Search Report dated Sep. 12, 2017, issued in corresponding International Application No. PCT/EP2017/065974, filed Jun. 28, 2017, 5 pages.
Mushtaq, A., et al., "Preparation and Characterization of Silver Coated Alumina for Isolation of Iodine-131 From Fission Products," Journal of Engineering and Manufacturing Technology 2(1):1-9, Mar. 2014.
Rupp, A.F., et al., "Production of Fission Product Iodine 131," Oak Ridge National Laboratory, Oak Ridge, Tenn., Dec. 18, 1951, <http://web.ornl.gov/info/reports/1951/3445603527565.pdf> [retrived Feb. 6, 2017], 26 pages.
Salacz, J., "Reprocessing of Irradiated Uranium 235 for the Production of Mo-99, I-131, Xe-133 Radioisotopes," Revue IRE Tijdschrift 9(3):22-28, Jan. 1985.
Written Opinion of the International Searching Authority dated Sep. 12, 2017, issued in corresponding International Application No. PCT/EP2017/065974, filed Jun. 28, 2017, 5 pages.
International Preliminary Report on Patentability dated Jan. 1, 2019, issued in corresponding International Application No. PCT/EP2017/065974, filed Jun. 28, 2017, 1 page.

* cited by examiner

*Primary Examiner* — Michael G. Hartley
*Assistant Examiner* — Jagadishwar R Samala
(74) *Attorney, Agent, or Firm* — Christensen O'Connor Johnson Kindness PLLC

(57) ABSTRACT

A method for producing an iodine radioisotopes fraction, comprising the steps of dissolving enriched uranium targets forming a slurry, filtering said slurry, absorbing salts of iodine radioisotopes on an aluminium resin doped with silver and recovering said iodine radioisotopes fraction, is disclosed. The recovery of the iodine radioisotopes fraction, in particular of I-131, comprises washing the aluminium resin doped in silver using a solution of NaOH and eluting of iodine radioisotopes by a solution of thiourea, and collecting an eluate containing said iodine radioisotopes in a thiourea solution.

18 Claims, No Drawings

METHOD FOR PRODUCING AN IODINE RADIOISOTOPES FRACTION, IN PARTICULAR OF I-131, IODINE RADIOISOTOPES FRACTION, IN PARTICULAR OF I-131

The present invention relates to a method for producing an iodine radioisotopes fraction, in particular of I-131, comprising steps of:

(i) Alkaline (or based) dissolution of enriched uranium targets by obtaining an alkaline (or based) slurry containing aluminium salts, uranium and isotopes generated by the fission of enriched uranium and a gaseous phase of Xe-133, (ii) Filtration of said alkaline (or based) slurry in order to isolate, on the one hand, a solid phase containing the uranium, and on the other hand, an alkaline (or based) solution of molybdate and salts of iodine radioisotopes, (iii) Adsorption of said salts of iodine radioisotopes on an alumina resin doped with silver and recovery of said alkaline (or based) solution of molybdate depleted of iodine radioisotopes, in particular of I-131, passing through said alumina resin doped with silver, and (iv) Recovery of said iodine radioisotopes fraction, in particular of I-131.

Such a method is well-known and described in the document "Preparation and characterization of silver coated alumina for isolation of iodine-131 from fission products. Mushtaq et al.—Journal of Engineering and Manufacturing Technology, 2014".

According to this document, the highly enriched uranium targets are processed for the purpose of producing radioisotopes of molybdenum-99 and radioisotopes of iodine-131 by alkaline dissolution. As mentioned above, the alkaline slurry is then filtered and the alkaline liquid phase (filtrate) is loaded on an alumina resin doped with silver.

A fraction containing the iodine radioisotopes, in particular of iodine-131, is recovered by elution of the alumina column doped with silver by sodium thiosulfate ($Na_2S_2O_3$). According to this document, the recovered fraction containing the iodine radioisotopes, in particular iodine-131, is not sufficiently pure and must also be distilled for medical applications. Elution with sodium thiosulfate should lead to the recovery of about 90% of the iodine radioisotopes, in particular of iodine-131, loaded on the alumina column doped with silver.

Unfortunately, this document is silent regarding the overall purification yield. Although it details the elution yields with respect to the total quantity of iodine loaded on the column, the document does not give any information about the iodine purification yield with respect to the basic alkaline resulting from the dissolution of the targets.

Another method for producing an iodine radioisotope fraction, in particular of iodine-131 is described in the document "Reprocessing of irradiated Uranium 235 for the production of Mo-99, I-131, Xe-133 radioisotopes. J. Salacz—revue IRE tijdschrift, vol 9, No 3 (1985)".

According to this document, processing the products of the fission of uranium for the purpose of producing short-lived radioisotopes involves highly restrictive working conditions.

These particularly restrictive working conditions involve having to work in shielded cells using robotic arms, or working outside shielded cells using the handling devices of the production chain to operate robotic arms. Once the methods for processing the targets containing highly enriched uranium are well established and secured to ensure very low or no environmental pollution, the production of radioisotopes method is clearly fixed. The smallest change to these methods is, if possible, to be avoided in order not to disrupt the production scheme, because when the environmental pollution level is considered to be secured, each change is considered as a new risk to manage in order to achieve a new satisfactory design of environmental constraints. Furthermore, the method is conducted in cells that are fitted with portholes of led-shielded glass several tens of centimetres thick, through which articulated arms, robotic or not, are operated from the outside.

Several cells follow each other. In each cell, a part of the method is carried out.

A first cell is dedicated to dissolve the targets of highly enriched uranium. Once the liquid phase containing the soluble products of uranium fission is recovered through filtration, including the radioisotope of Mo-99, it is transferred to the second cell where it is acidified to enable, during the exothermic acidification step, a gaseous release of iodine.

The solution from which the iodine is released, is heated and bubble-stirred to release iodine in a gaseous form. The gas containing the iodine radioisotopes is then captured using a platinised asbestos trap. Iodine radioisotopes, in particular of I-131, are then desorbed from the platinised asbestos trap and sent to the cell where they undergo chemical purification by distillation.

The iodine radioisotope yields, in particular of I-131, described in this document are of about 80 to 90%. 10 to 20% of the iodine radioisotopes, in particular of I-131, remain in the acidified liquid phase and contaminate the other radioisotopes.

Thus, according to this document, the selectivity of the iodine isolation for the production thereof is not optimal. Furthermore, during the exothermic acidification, although the temperature of the acidified liquid phase increases, it is also necessary to provide further heating and bubble-stirring to try to recover a maximum of iodine radioisotopes, in particular of I-131.

This heating causes the evaporation of the nitrates resulting from the acidification with nitric acid, thereby contaminating the iodine radioisotopes, in particular of I-131 in a gaseous form, which is problematic as it interferes with the marking process of subsequent biological molecules.

There is therefore a need to provide a method enabling to produce iodine with a better yield, by reducing environmental hazards and by securing and reducing potential releases of iodine in the ventilation system, but also where the production selectivity is improved to increase the purity of the iodine radioisotopes fractions, in particular of I-131.

The purpose of the invention is to overcome the disadvantages of the state of the art by providing a method enabling to improve the purity of the produced iodine by acting on the selectivity of the production operations while reducing environmental hazards.

To overcome this issue, a method is provided according to the invention and as described at the beginning wherein said recovery of said iodine radioisotopes fraction, in particular of I-131, comprises a washing of the alumina resin doped with silver with a solution of NaOH at a concentration comprised between 0.01 and 0.1 mol/l, preferably between 0.03 and 0.07 mol/l and more preferably of about 0.05 mol/l, and an elution of the iodine radioisotopes, in particular of I-131 by a thiourea solution presenting a thiourea concentration comprised between 0.5 mol/l and 1.5 mol/l, preferably comprised between 0.8 and 1.2 mol/l, more preferably of about 1 mol/l, with the collection of an eluate containing said iodine radioisotopes, in particular I-131, in a thiourea solution.

By performing this fixation step on a column of alumina doped with silver, about 90% of the iodine radioisotopes contained in the alkaline (or based) solution of molybdate and of the salts of iodine radioisotopes are fixed on the alumina resin doped with silver.

According to the present invention, the alumina column is manufactured according to the disclosures of document "Preparation and characterization of silver coated alumina for isolation of iodine-131 from fission products. Mushtaq et al.—Journal of Engineering and Manufacturing Technology, 2014", with the exception that the silver is reduced with hydrazine instead of sodium sulphate.

The impregnation rate of the alumina resin by silver is of at least 4, preferably of at least 5, more preferably of about 5.5% by weight of silver with respect to the total weight of non-doped alumina.

By performing an elution with thiourea according to the present invention, it was revealed, surprisingly, that the rate of iodine radioisotopes, in particular of eluted iodine-131, with respect to the total content of iodine radioisotopes, in particular of iodine-131 loaded on the alumina column, was greater than 90%, and even greater than 95% in activity.

In addition, the elution using thiourea is quicker and carries out a narrower elution peak, thereby increasing the selectivity of the purification of iodine radioisotopes, in particular of iodine-131, while also reducing to a minimum the presence of other radioisotopes in the eluate of the alumina column doped with silver. In addition, according to the present invention, the volume of the washing solution is configured to be optimised and sufficiently delayed with respect to the passage of molybdenum through the column, for example with the presence of Mo-99 radioisotopes that would otherwise contaminate the eluate of iodine radioisotopes, in particular of I-131, but not too much to prevent the loss of iodine radioisotopes, in particular of iodine-131.

Consequently, in the method according to the present invention, the selectivity of the iodine recovery, in particular of iodine-131, is improved along with the environmental safety, by the adsorption of iodine radioisotopes, in particular of iodine-131, on an alumina resin doped with silver, rather than imperatively having to pass the total quantity of iodine radioisotopes, in particular of iodine-131, of the alkaline solution of molybdate and the salts of iodine radioisotopes in a gaseous phase, to recover the totality of iodine radioisotopes, in particular of iodine-131, via a gas trap.

In an advantageous embodiment, said uranium targets are low enriched uranium targets.

Although the method according to the present invention applies to all types of targets, in particular to highly enriched uranium targets, but also to low enriched targets, the embodiment based on low enriched-enriched uranium targets is preferred.

Indeed, the production of radioisotopes for medical applications has long relied on highly enriched uranium.

Highly enriched uranium (HEU) is challenging in terms of worldwide safety considerations as it is relatively vulnerable to terrorist organisations and because of the potential thereof in the development of a nuclear weapon. Although the many facilities producing radioisotopes for medical applications feature sturdy security measures, minimising the use of highly enriched uranium in civilian applications is a significant act contributing to reducing the danger of proliferation.

Despite improved efficiency in the production of radioisotopes from HEU, both in financial terms and in environmental terms, the conversion of the method for producing radioisotopes from HEU is significantly restricted by the USA, which remains the main source of uranium as a crude material. The United States has just taken all the necessary measures to promote the use of LEU by implementing compensatory measures accompanying the use of radioisotopes produced from low enriched uranium (LEU), by introducing limits to the acquisition and delivery of HEU, or by introducing penalties on the use of Mo-99 produced from HEU.

In this context, there is therefore a need to develop a method for producing fractions containing a radioisotope of I-131 that make it possible to achieve a satisfactory compromise in terms of the economic efficiency of the production method, while reducing the use of highly enriched uranium.

Unfortunately, given that the quantity of radioisotopes is directly linked to the quantity of uranium-235, and for the purpose of guaranteeing the same procurement level of pure I-131 medical isotopes, low enriched uranium-based targets contain overall much more uranium that highly enriched uranium targets, and therefore contain much more unusable matter (up to 5 times more).

It is therefore advantageous, according to the present invention, to implement the method to process low enriched uranium targets, despite the presence of contaminants that are very different from those produced by highly enriched uranium targets, thereby increasing environmental safety, while maintaining/improving purity by acting on the selectivity with respect to iodine radioisotopes, in particular I-131, and by maintaining the qualitative criteria of iodine radioisotopes fractions, in particular of I-131.

Advantageously, according to the present invention, the method further comprises, before said filtration an addition of alkaline-earth nitrate, more particularly of strontium, calcium, barium, preferably of barium and sodium carbonate to said alkaline slurry.

Indeed, according to the present invention, it was possible to create a method that can be used industrially, by optimising the selectivity of the production of iodine radioisotopes, in particular of iodine-131, with acceptable yields and with improved environmental safety, and wherein also, despite the presence of 5 times more unusable matter, the production of radioisotopes of Mo-99 enables to achieve the required purity for a medical application and also improves environmental safety (both for the environment and for the operators).

It has been demonstrated in the method according to the present invention that the alkaline dissolution of the targets, generating a slurry with a much higher concentration of solid unusable matter, but also of contaminants of the liquid portion of the slurry, could be efficiently filtered by the addition of alkaline-earth nitrate, more particularly of strontium, calcium, barium, preferably of barium and sodium carbonate. Indeed, when the alkaline-earth nitrate, more particularly of strontium, calcium, barium, preferably of barium, is added to the slurry, along with sodium carbonate, insoluble carbonates are formed, such as for example of barium, but also of strontium and other carbonates that serve as a filtrating medium during filtration, thereby preventing the clogging of the pores of the fibreglass filter. This has made it possible to achieve a significant reduction of the filtration time. According to the present invention, the filtration time of the slurry was reduced by 4 to 6 hours to a reduced time comprised between 30 minutes and 2 hours, based on the amount of targets involved in the dissolution. This is already significantly higher than with a method using highly enriched uranium-based targets (where the filtration time is typically from 10 to 20 minutes), but this method represents a possibility of industrial implementations which, otherwise, would not have existed without excessively increasing the production cost of radioisotopes produced by the fission of uranium 235.

With low enriched uranium-based targets, the solid phase content of the slurry is 5 times higher. In addition, typically, these targets are based on an aluminium and uranium alloy, in particular in the form of $UAl_2$, although other forms of the alloy are also present (such as $UAl_3$, $UAl_4$, etc.). Low enriched uranium-based targets contain less than 20% by weight of uranium 235 with respect to the total weight of uranium present in the target. Highly enriched uranium-based targets contain more than 90% by weight of uranium 235 with respect to the total weight of uranium present in the target. Consequently, the enriched uranium content is proportionally and significantly reduced (by a factor of about 5).

Furthermore, by working with an alloy, among others with $UAl_2$, it is possible to increase the uranium density present in the target, which clearly improves the production yield, but also creates other impurities, such as magnesium, which affect the method for producing radioisotopes of Mo-99 for medical applications. Indeed, the increase of the uranium density of the uraniferous nucleus has imposed the replacement of pure A5 aluminium with a harder alloy. Indeed, with this increased density, in the case of pure A5 being used, the integrity of the targets (and the absence of deformation thereof) during the production thereof would not be guaranteed. It is therefore not the use of $UAl_2$ that brings Mg as impurity, but the fact that the uranium $UAl_2$ alloy is denser and the fact that the total quantity of uranium has increased, which requires the use of an aluminium alloy, containing the Mg, for the production of the targets.

Consequently, in the method according to the present invention, although the content in highly radioactive waste has increased, it has been possible not only to filter the slurry in an industrially-usable time, but also to eliminate the impurities brought by the use of a uranium and aluminium alloy in the slurry.

In particular, in the method according to the present invention, the contamination of the Mo-99 radioisotope fraction by the Sr-90 radioisotope is reduced as it precipitates with the carbonate brought to the slurry. This is of the utmost importance as the radiotoxicity of the Sr-90 radioisotope is very high because of the combination of the extended physical half-life thereof (radioactive half-life: 28.8 years), the high-energy beta decay thereof and the long biological half-life thereof (bone tropism). It is therefore very important to reduce this impurity to minimise the potential long-term side effects for the patient.

In addition, although it is relatively essential, the filtration adjuvant used in the method according to the present invention does not affect the fixation of the iodine on the silver-coated alumina column, on the contrary, given the already-reduced presence of contaminants in the source, the present invention reveals that it is possible to produce, in a profitable and efficient manner, on the one hand, a Mo-99 radioisotope from low enriched uranium, without the radioisotope fraction being ultimately less pure, thereby satisfying the criteria of the European Pharmacopoeia, despite the massive presence of a much greater quantity of waste and contaminants that are difficult to eliminate, such as magnesium, but also wherein, on the other hand, the risk of the presence of strontium in the Mo-99 radioisotope fraction is largely reduced, but in which about 90% of the iodine present in the alkaline slurry is collected on the alumina column doped with silver after the filtration.

In a first advantageous embodiment of the method according to the present invention, the method further comprises an acidification of said eluate containing said iodine radioisotopes, in particular I-131 in a thiourea solution by the addition of a buffer solution, in particular a solution of phosphoric acid with a concentration comprised between 0.5 and 2 mol/l, preferably between 0.8 and 1.5 mol/l, and more preferably of about 1 mol/l, with a recovery of an acidified solution of iodine radioisotope salts, in particular of I-131.

According to the present invention, the iodine radioisotopes, in particular iodine-131 are acidified for the purpose to be pre-purified and separated from most of the contaminants, including the thiourea, used beforehand to recover the iodine from the silver-coated alumina.

In the scope of the present invention, the term "effluent of the resin" is used to describe the mobile phase that passes through the resin and leaves the chromatography column.

In a preferred embodiment of the present invention, the method further comprises a purification of said acidified solution of iodine radioisotope salts, in particular of I-131, said purification comprising a loading of said acidified solution of iodine radioisotope salts, in particular of I-131 on an ion-exchange column, a washing of said ion-exchange resin with water, an elution of said ion-exchange resin with NaOH at a concentration between 0.5 and 2.5 mol/l, preferably between 0.8 mol/l and 1.5 mol/l and particularly preferably of about 1 mol/1, with a recovery of said iodine radioisotopes fraction, in particular of I-131, in a solution of NaOH.

Advantageously, said ion-exchange resin is a weak anion resin.

In another embodiment of the method according to the invention, the method also comprises an acidification of the alkaline solution of molybdate depleted of iodine radioisotopes, in particular of I-131 passing through said alumina resin doped with silver, with formation of an acid solution of molybdenum salts and release of residual iodine radioisotopes, in particular of I-131, in the form of gas for the purpose of the recovery thereof.

In this variant of the method according to the present invention, as mentioned above, the quantity of iodine radioisotopes, in particular of iodine-131, recovered by adsorption on the alumina column doped with silver is of about 90% by activity with respect to the total activity of iodine radioisotopes, in particular of iodine-131. The residual 10% of iodine radioisotopes, in particular of iodine-131, are still present in the alkaline molybdate solution previously passed through said alumina column doped with silver. Consequently, recovering in a separate step the residual iodine is advantageous for two reasons. Firstly, the iodine thus recovered can be enhanced in the form of an iodine radioisotopes fraction, in particular of iodine-131, and secondly because the presence of residual iodine in the alkaline molybdate solution generates the environmental hazard of having these iodine radioisotopes, in particular iodine-131, being released in the ventilation system, which is also connected to the chimney.

Consequently, isolating the iodine at this stage represents a profitability potential in the scope of the method according to the present invention, but also reduces the environmental risk associated with the iodine in the method according to the present invention.

Preferably, in another advantageous embodiment of the method according to the present invention, the method further comprises, before said acidification of the alkaline molybdate solution depleted of iodine radioisotopes, in particular of I-131 passing through said alumina resin doped with silver, a cooling of the alkaline molybdate solution depleted of iodine radioisotopes, in particular of I-131 passing through said alumina resin doped with silver, to a temperature below or equal to 60° C., preferably below or equal to 55° C., more particularly below or equal to 50° C.

In this manner, it was surprisingly observed that the purity and yield of the produced iodine radioisotopes fractions, in particular of I-131, were improved.

According to the present invention, it was highlighted that to solve this problem relating to the difficulty in controlling the massive release of iodine at high temperatures, simply cooling the aqueous alkaline phase resulting from the filtration before acidification to a temperature below or equal to 60° C., preferably below or equal to 55° C., more particularly below or equal to 50° C., favours the solubility of the iodine in the acid solution of molybdenum salts. In this manner, owing to the fact that the solubility of the gases decreases with the increase of the temperature, the cooling of the aqueous alkaline phase resulting from the filtration enables a slower volatilisation of the iodine, and therefore prevents the sudden release thereof when the acid is added. Indeed, when iodine is brought to the iodine trap suddenly, the capture of the iodine is negatively impacted, while the cooling enabling a controlled release improves the yield of capture by the trap.

During acidification, the temperature of the acid solution of molybdenum salts increases progressively and makes it possible for an equally progressive release of the iodine towards the trap, which favours the capture thereof, unlike the massive release of the iodine.

Consequently, according to the present invention, it is possible to improve the production yield of iodine radioisotopes, in particular of I-131, from aluminium targets containing highly enriched uranium very simply, by cooling the filtrate to prevent the massive release of iodine in the iodine trap during the acidification to a temperature of about 50° C., and in any case below 60° C. The filtrate is therefore acidified by concentrated nitric acid. The iodine radioisotopes are then released during the acidification in far greater quantities.

In a specific embodiment of the present invention, the method further comprises, after acidification, heating of the acid solution of molybdenum salts to a temperature greater than 93° C., preferably greater than or equal to 95° C., preferably between 96° C. and 99° C., but preferably below 100° C., accompanied by air bubbling to optimise the release of iodine in a gaseous form, at a precisely determined moment, during and after acidification.

Advantageously, in the method according to the present invention, said recovery of the iodine radioisotopes, in particular I-131 upon the release thereof is carried out by a transfer of the iodine radioisotopes, in particular I-131 in the form of gases in a pipe connected at one end to an acidifier wherein the acidification occurs and at the other end to a closed container containing an aqueous phase and a surrounding medium, said transfer of iodine radioisotopes, in particular I-131 in the form of a gas being carried out so as to result directly in the aqueous phase wherein the iodine radioisotopes, in particular I-131, in the form of gas pass through the aqueous phase and escape in the form of bubbles in the surrounding medium of the aqueous phase, contained in the closed container.

In this manner, the nitrates that might be present in the form of aerosols, as well as other gaseous species soluble in water, such as nitrogen oxides, are solubilised and eliminated from the iodine radioisotopes, in particular from I-131, in the form of a gas.

Also, in another embodiment of the present invention, said closed container is connected by a pipe to a second closed container that contains an NaOH trap and wherein the surrounding medium of the aqueous phase is transferred from the closed container to the second closed container containing the NaOH trap in the form of a solution at a concentration from 2 to 4, in particular of about 3 mol/l, with discharge of the surrounding medium containing the iodine radioisotopes, in particular I-131 of the pipe into the solution of the NaOH trap, with solubilisation of the iodine radioisotopes, in particular I-131 in the form of gas into iodide of iodine radioisotopes, in particular I-131 in the aqueous solution of the NaOH trap.

The iodine radioisotopes, in particular I-131 are thus dissolved in the NaOH aqueous solution at an NaOH concentration from 2 to 4 mol/l, preferably of 3 mol/l, and form a crude iodine solution.

In a preferred embodiment of the method according to the present invention, the aqueous solution of the NaOH trap containing the iodides of the iodine radioisotopes, in particular I-131, forms a crude iodine solution, which is then purified by a second acidification to form gaseous iodine. The crude solution is transferred to an iodine purification cell. The crude solution is then acidified by $H_2SO_4$+$H_2O_2$ to again produce the gaseous iodine, which is captured in NaOH 0.2 M bubblers. This solution is called the "stock solution", and it is then packaged in sealed vials, depending on the orders.

Alternately, the iodine radioisotopes fraction, in particular of I-131 in an NaOH solution containing the iodides of the iodine radioisotopes, in particular of I-131, forms a crude iodine solution and is then purified by a second acidification, preferably carried out in the presence of $H_2SO_4$ and $H_2O_2$ to again produce the gaseous iodine. Then, preferably, the gaseous iodine is captured in NaOH 0.2 M bubblers to form said fraction containing a radioisotope of iodine-131.

In an advantageous embodiment, said iodine radioisotopes fraction, in particular of I-131 in an NaOH solution and the aqueous solution of the NaOH trap containing the iodides of iodine radioisotopes, in particular I-131, are collected and purified together by a second acidification.

Other embodiments of the method according to the invention are indicated in the appended claims.

The invention also relates to an iodine radioisotopes fraction, in particular of I-131 conditioned in a solution of NaOH having a radiochemical purity in iodine radioisotopes, in particular of I-131 greater than 97%, preferably of at least 98%, more particularly of at least 98.5% of the activity present in the chemical iodide form of said radioisotope of the I-131 with respect to the total activity of said radioisotope of I-131 in all the forms thereof in said fraction.

More specifically, said solution of iodine radioisotopes, in particular of I-131, is conditioned in sealed vials, said sealed vials being enclosed in individual shielded containers.

Advantageously, the iodine radioisotopes fraction, in particular of I-131, presents a nitrate content of below 30 g/l.

In an advantageous version, the iodine radioisotopes fraction, in particular of I-131, is obtained by the method according to the present invention.

Other embodiments of the fraction according to the invention are indicated in the appended claims.

Other characteristics, details and advantages of the invention will become apparent from the description given hereafter, with reference to the examples and not limited thereto.

When the uranium 235 is bombarded with neutrons, it forms fission products with a smaller mass and which are themselves unstable. These products generate, through a decay chain, other radioisotopes. In particular, it is by this process that the Mo-99, Xe-133 and I-131 radioisotopes are produced.

The low enriched uranium-based targets contain an aluminium alloy containing uranium. The content of enriched uranium with respect to the total weight of uranium is at most of 20%, and typically of around 19%. The low enriched uranium targets are dissolved during the alkaline dissolution phase in the presence of NaOH (at about 4 mol/l or more) and of $NaNO_3$ (at about 3.5 mol/l). During the dissolution, a slurry is formed along with a gaseous phase of Xe-133. The slurry contains a solid phase mainly formed from uranium and hydroxides of fission products and a liquid phase of molybdate ($MoO_4^-$) and of iodine-131 in the form of iodine salts.

The volume of the alkaline dissolution phase increases with the amount of targets, given the very high content of unusable products after dissolution of the targets. The dissolution of the aluminium of the target is an exothermic reaction.

The gaseous phase of xenon is recovered by capture using a xenon trap.

When the xenon is eliminated, a solution of alkaline-earth nitrate, more particularly of strontium, calcium, barium, preferably of barium, is then added to the slurry at a concentration of between 0.05 mol/l and 0.2 mol/l and in a quantity of 2 to 6 litres, depending on the number of targets. Sodium carbonate is also added at a concentration comprised between 1 mol/l and 1.5 mol/l, preferably of about 1.2 mol/l, and in a quantity of 100 to 300 ml, depending on the number of dissolved targets.

The slurry is then diluted with water in a volume of 2 to 6 litres, depending on the number of targets, to make it possible for the transfer thereof to the subsequent step.

The slurry containing the liquid phase and the basic phase is then filtered through a fibreglass filter with a porosity comprised between 2 and 4 μm, preferably of about 3 μm.

The solid phase is washed twice with a volume of water of 900 ml, recovered and possibly sent upstream from the method for a subsequent alkaline dissolution. The filtrate (recovered alkaline liquid phase containing the Mo-99, I-131, I-133, I-135, Cs-137, Ru-103, Sb-125 and Sb-127 fission products) is recovered, along with the aluminate formed by the alkaline dissolution of the aluminium targets, which is soluble in a basic pH. Aluminium is soluble both in an acid and in an alkaline medium. However, it is insoluble when the pH ranges from 5 to 10.

At this stage, the filtrate is loaded on an alumina column doped with silver in order to fix the iodine and recover an alkaline filtrate depleted of iodine-131. The alumina column doped with silver is washed with a volume of about 500 ml of caustic soda at a concentration of about 0.05 mol/l. The impregnation rate of the alumina resin contained in the alumina column is about 5.5% by weight. The iodine is fixed selectively by reaction with the silver doping present at the surface of the alumina to form an insoluble silver iodide. The alumina column doped with silver is preferably positioned in between two reactors. The reactor downstream from the alumina column doped with silver is placed under a controlled vacuum, which enables the transfer of the liquid onto the column at a flow rate of about 250 ml/min.

The yields of the iodine capture are of about 95%.

The alumina column doped with silver is then eluted with a thiourea solution with a concentration comprised between 0.5 mol/l and 1.5 mol/l, preferably of about 1 mol/l. The eluate contains iodine coming from the column. The eluate is then brought to an acid pH by adding a buffer mixture, in particular of phosphoric acid, in order to obtain an acid solution of iodine salts.

The acid solution of iodine salts is then loaded on an ion-exchange column, in particular on a weak anion resin column pre-processed in a non-oxidising acid medium, in particular with phosphoric acid. In this manner, in terms of safety, in this advantageous embodiment of the method according to the present invention, the activity of the iodine fixed on the ion-exchanging resin is transferred from one cell to the next in a solid form. The ion-exchange column on which the iodine is fixed is then eluted with NaOH at a concentration of between 0.5 mol/l and 2.5 mol/l, preferably of about 1.

The iodine radioisotopes are thus transformed into iodide and solubilised in the NaOH.

The fraction containing the iodine radioisotopes undergoes a first purification step using the second acidification.

The collected filtrate must then be acidified. However, the acidification also causes the release of heat. Consequently, prior to acidification, the filtrate is cooled to a temperature of about 50° C. Indeed, as disclosed in the document "Form and Stability of Aluminium Hydroxide Complexes in Dilute Solutions" (J. D. Hem and C. E. Roberson—Chemistry of Aluminum in Natural Water—1967), the behaviour of aluminium in a solution is complex and the transformation reactions of the $Al^{3+}$ ion into the precipitated hydroxide form and the aluminate soluble form are subject to a certain amount of kinetics.

The formation of metastable solids is known and the conditions of equilibrium are sometimes difficult to achieve, even with long reaction times. Aluminium oxides and hydroxides form different crystalline structures (bayerite, gibbsite, etc.) that are chemically similar but differ in terms of solubility. The experimental conditions of temperature, concentration and speed of addition of the reagents significantly affect the results.

The reaction that governs the equilibrium between the various forms of aluminium is as follows during acidification:

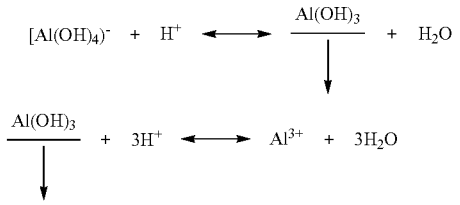

As the medium is highly radioactive and at a high temperature because of the alkaline dissolution, but also because of the exothermic character of neutralisation during the acidification step, the addition of acid would form, in localised sites, acid overconcentration that would lead to local heating by the neutralisation reaction, and to the formation of insoluble aluminium forms or with slow aluminium salts re-dissolution kinetics. However, given the restrictions of the method described in the state of the art, given that the reaction environment has a high temperature, given that it is highly radioactive and difficult to access, it is not possible to maintain the stirring to avoid these local sites of aluminate concentration at high temperature.

The effects of acid overconcentration must be avoided for two main reasons. On the one hand, the formation of aluminium salt precipitates significantly risks clogging the installation, which reduces the production yield, and on the other hand it also creates a health risk considering the high radioactivity of the reaction mixture. Indeed, it is not simple, and maybe not even possible, to intervene manually to unclog the installation, but furthermore, this could only be done to the detriment of the production yield.

Consequently, the filtrate is cooled so as to avoid the precipitation of the aluminium salts during the acidification at a temperature of about 50° C., and in any case of below 60° C. The filtrate is therefore acidified with concentrated nitric acid. The acidified filtrate is heated to a temperature greater than 93° C., preferably greater than or equal to 95° C., preferably between 96° C. and 99° C., but preferably of less than 100° C., and maintained in a bubbling state.

In a first embodiment of the present invention, the acidification makes it possible to carry out a solution with an acid pH in order to fix the Mo-99 radioisotope on the alumina column (in the presence of an excess of acid of about 1 M).

The acidified liquid phase, depleted of iodine, is then loaded onto an alumina column, which is conditioned in nitric acid at a concentration of 1 mol/l. The Mo-99 is adsorbed on the alumina while most of the contaminant fission products are eliminated in the effluent of the alumina column.

The alumina column on which the Mo-99 radioisotope is fixed, is washed with nitric acid at a concentration of 1 mol/l, with water, with sodium sulphite at a concentration of about 10 g/l and finally once again with water. The washing effluent is discarded.

The alumina column is then eluted with NaOH at a concentration of about 2 mol/l and then with water.

The eluate recovered from the alumina column forms the first eluate of the Mo-99 radioisotope in the form of molybdate.

In a preferred embodiment of the method according to the present invention, the first eluate of the column is kept for a period of between 20 and 48 hours. After this predetermined period, the alumina column is once again eluted with NaOH at a concentration of about 2 mol/l and then with water, prior to the washing thereof. The eluate recovered from the new elution forms the second eluate of the Mo-99 radioisotope in the form of molybdate.

At this stage, the first eluate of the Mo-99 radioisotope can be collected with the second eluate of the Mo-99 radioisotope and forms a single eluate which will undergo further purification steps. Alternately, each first and second eluate is treated individually in subsequent purification steps, in the same manner.

For more simplicity, below, the eluate of the Mo-99 radioisotope will be referred to, to describe the first eluate of the Mo-99 radioisotope or the second eluate of the Mo-99 radioisotope, or both together.

The eluate of the Mo-99 radioisotope of the alumina column is then loaded onto a second chromatography column containing a high anion ion-exchange resin pre-processed in water.

The ion-exchange column is then eluted with nitrate using a solution of ammonium nitrate at a concentration of about 1 mol/l. The recovered eluate therefore comprises the Mo-99 radioisotope in a fraction containing ammonium nitrate.

The solution of ammonium nitrate containing the radioisotope of Mo-99 is then loaded on an activated carbon column with a 35-50 mesh, which can also be doped with silver to recover any trace amounts of iodine. The activated carbon column on which the Mo-99 radioisotope is fixed is then washed with water and eluted with a solution of NaOH at a concentration of about 0.3 mol/l.

The elution of the activated carbon column makes it possible for the recovery of a solution of $Na_2{}^{99}MoO_4$ in NaOH and to keep any iodine possibly captured on the column at a preferred concentration of 0.2 mol/l, which will then be packaged and prepared for delivery.

In a particular embodiment of the invention, the solution of $Na_2{}^{99}MoO_4$ in NaOH at a preferred concentration of 0.2 mol/l is loaded onto an alumina resin in a Mo-99/Tc-99 generator or on a resin of titanium oxide to make it possible for the generation of a technetium-99 radioisotope for nuclear medicine.

In a second advantageous embodiment of the method according to the present invention, the acidification enables to achieve a solution with an acid pH to fix the Mo-99 radioisotope on the titanium oxide column (in the presence of an excess of acid 1 M).

The acidified liquid phase, depleted of iodine, is then loaded onto a titanium oxide column, processed in nitric acid at a concentration of 1 mol/l. The Mo-99 is adsorbed on the titanium oxide, while most of the contaminant fission products are eliminated in the effluent of the titanium oxide column.

The titanium oxide column on which the Mo-99 radioisotope is fixed is washed with nitric acid at a concentration of 1 mol/l, with water, with sodium sulphite at a concentration of about 10 g/l and finally once again with water. The washing effluent is discarded.

The titanium oxide column is then eluted with NaOH at a concentration of about 2 mol/l and then with water.

The eluate recovered from the titanium oxide column forms the first eluate of the Mo-99 radioisotope in the form of molybdate, and comprises about 90% or more of the Mo-99 initially present.

In a preferred embodiment of the method according to the present invention, the first eluate of the column is kept for a period of between 20 and 48 hours. After this predetermined period, the elution of the titanium oxide column is continued with NaOH at a concentration of about 2 mol/l and forms an elution tail containing the Mo-99 radioisotope, in the form of molybdate.

At this stage, the first eluate of molybdate and/or said molybdate eluate tail are collected or not and acidified with a solution of sulphuric acid at a concentration comprised between 1 and 2 mol/l, preferably of 1.5 mol/l, thereby forming an acidified fraction of the pure Mo-99 radioisotope, in the form of molybdenum salts.

For more simplicity, below, the eluate of the Mo-99 radioisotope will be referred to, in the form of molybdate to describe the first eluate of the Mo-99 radioisotope or the tail of the molybdate eluate, or both together.

The eluate of the Mo-99 radioisotope of the titanium oxide column is then loaded onto a second chromatography column containing a weak anion ion-exchange resin pre-processed in water.

The ion-exchange column is then eluted with nitrate using a solution of ammonium nitrate at a concentration of about 1 mol/l. The recovered eluate therefore comprises the Mo-99 radioisotope in a fraction containing ammonium nitrate.

The solution of ammonium nitrate containing the radioisotope of Mo-99 is then loaded on an activated carbon column with a 35-50 mesh, which can also be doped with silver to recover any trace amounts of iodine. The activated carbon column on which the Mo-99 radioisotope is fixed is then washed with water and eluted with a solution of NaOH at a concentration of about 0.3 mol/l.

The elution of the activated carbon column makes it possible for the recovery of a solution of $Na_2{}^{99}MoO_4$ in NaOH and to keep any iodine possibly captured on the column at a preferred concentration of 0.2 mol/l, which will then be packaged and prepared for delivery.

In a specific embodiment of the invention, the solution of $Na_2{}^{99}MoO_4$ in NaOH at a preferred concentration of 0.2 mol/l is loaded onto an alumina resin in a Mo-99/Tc-99 generator or on a resin of titanium oxide to make it possible for the generation of a technetium-99 radioisotope for nuclear medicine.

During the formation of the slurry, the uranium fission products are released, some in a soluble form, others in a gaseous form. This is, among others, the case of xenon and krypton, which are therefore in a gaseous phase. The gaseous phase escapes from the liquid medium and remains contained in the sealed container wherein the dissolution occurs. The sealed container comprises a gaseous phase output connected to a device for the recovery of noble gases, isolated from the outside environment, as well as an input for a flushing gas.

The gaseous phase contains ammonia ($NH_3$) that comes from the reduction of the nitrates and from the main gaseous fission products, which are Xe-133 and Kr-85.

The dissolution is a highly exothermic reaction, imposing two large refrigerants. However, water vapour is present in the gaseous phase. The gaseous phase is transported by a carrier gas (He) towards the device for recovering noble gases.

In a first variant, the recovery of xenon is carried out as follows: The gaseous phase leaves the sealed container of alkaline dissolution and is brought towards the device for the recovery of noble gases. The gaseous phase containing, among others, the radioisotope Xe-133 is first passed through a molecular sieve to eliminate the ammonia ($NH_3$) and the water vapour. Then, the gaseous phase is passed through silica gel to eliminate all trace amounts of residual water vapour. The gaseous phase is then brought to the cryogenic trap.

In a second advantageous variant according to the present invention, the gaseous phase is adsorbed on zeolite, in particular on a titanosilicate or on an aluminosilicate doped with silver, preferably on Ag-ETS-10 or on Ag-chabazite. It is then marketed directly on the zeolite, or desorbed in heated conditions and sent towards a cryogenic trap.

The gaseous phase containing, among others, the radioisotope Xe-133 is therefore brought to the cryogenic trap in a U-shaped tube immersed in liquid nitrogen (i.e. at −196° C.) contained in a shielded container, through stainless steel shavings.

The stainless steel 316 shavings and manufactured from a stainless steel 316 rod, with a diameter of between 1.5 and 2 cm and with a length of between 10 and 20 cm, preferably between 14 and 18 cm, and more particularly of about 16 cm, using a four-flute end milling cutter with a diameter of 16 mm and a hydraulic vice. The speed of the milling machine comprising the abovementioned milling cutter is of 90 rpm and the travel speed thereof is of 20 mm/min. The cutting depth of the milling cutter is of about 5 mm.

The stainless steel shavings have an average weight comprised between 20 and 30 mg/shaving, preferably between 22 and 28 mg/shaving, and a non-packed bulk density comprised between 1.05 and 1.4.

The stainless steel shavings have an average length of 7 mm, an average diameter of about 2.5 mm and a thickness of about 1.7 mm.

The U-shaped tube comprises a quantity of comprised between 90 g and 110 g. The volume of stainless steel 316 shavings comprised in the U-shape tube is totally immersed in liquid nitrogen.

The radioisotope Xe-133 from said gaseous phase containing the radioisotope Xe-133 is then captured by liquefaction of said Xe-133 by said cooled stainless steel shavings that capture the Xe-133 by condensation.

The liquefaction temperature of the Xe-133 is of about −107° C. Consequently, the gaseous Xe is condensed to a liquid form on the stainless steel shavings.

However, as the liquefaction temperature of the Kr-85 is of about −152° C., there is a significantly smaller quantity of Kr trapped in the liquid nitrogen trap, and the residual Kr is collected in specific traps with the gases resulting from the method described herein, namely the gaseous phase substantially depleted of Xe-133, among others.

Once the Xe-133 has been captured in the liquid nitrogen trap, the ducts are purged, the injection of liquid nitrogen is cut and the trap is brought into contact with a vacuum bulb, the volume of which is 50 times greater than the volume of shavings contained in the liquid nitrogen trap.

The liquid nitrogen trap, in a closed circuit including the collection tube, is thus brought to ambient temperature. After warming, 99% of the Xe-133 initially present in a gaseous form is present in the bulb.

In a variant of the method according to the present invention, the residual iodine radioisotopes, in particular of I-131, that were not captured by the alumina resin doped with silver prior to acidification, are then recovered during the acidification of the alkaline slurry, which makes it possible to obtain a solution with an acid pH that is able to fix the radioisotope of Mo-99 on the alumina column, the acidification also releasing iodine radioisotopes for the purpose of the recovery thereof.

The recovery of the iodine can then be performed during and after the acidification of the pre-cooled alkaline filtrate.

The iodine radioisotopes are released by heating of the acidified filtrate to a temperature greater than 93° C., preferably greater than or equal to 95° C., preferably between 96° C. and 99° C., but preferably below 100° C., and maintained in a bubbling state to increase the release of iodine in a gaseous form.

When the acidified filtrate is heated, a gaseous phase is formed, containing the iodine radioisotopes along with an evaporated portion of the filtrate. The acidifier comprises a gaseous phase outlet pipe immersed in a closed container containing water. Another tube exits this closed container. The aqueous phase therefore leaves the acidifier and is left to bubble in the water contained in the closed container. In this manner, the portion of the filtrate that was evaporated is dissolved in the water contained in the closed container, while the insoluble portion, namely the iodine radioisotopes, remains above the water surface, in the closed container, and exits therefrom through the outlet pipe of the closed container and travels towards a second closed container, which is a trap containing NaOH at a concentration of 3 mol/l. The iodine radioisotopes are then transformed into iodide and solubilised in the NaOH contained in the iodine trap, where it forms a crude iodine solution.

In a preferred embodiment of the method according to the present invention, the aqueous solution of the NaOH trap containing the iodides of the iodine radioisotopes, in particular of I-131, is then purified by a second acidification.

The crude solution is transferred to an iodine purification cell. The crude solution is then acidified by $H_2SO_4$+$H_2O_2$ to produce again the gaseous iodine, which is captured in NaOH 0.2 M bubblers. This solution is called the "stock solution", and it is then packaged in sealed vials contained in a shielded enclosure to be shipped to the customer.

It is understood that the present invention is by no means limited to the embodiments described above and that many modifications may be made thereto without departing from the scope of the appended claims.

The invention claimed is:

1. A method for producing an iodine radioisotopes fraction, comprising the following steps:

(i) dissolving enriched uranium targets by contacting with base to obtain an alkaline slurry containing aluminium salts, uranium, and isotopes generated by the fission of enriched uranium and a gaseous phase of Xe-133, wherein the alkaline slurry comprises a solid phase containing uranium and an alkaline solution comprising molybdate and salts of iodine radioisotopes, (ii) filtering said alkaline slurry to separate the solid phase containing the uranium and the alkaline solution of molybdate and salts of iodine radioisotopes, (iii) adsorbing said salts of iodine radioisotopes on an alumina resin doped with silver and recovering an alkaline solution of molybdate depleted of iodine radioisotopes by passing the alkaline solution of molybdate and salts of iodine radioisotopes through said alumina resin doped with silver, and (iv) recovering said iodine radioisotopes fraction, wherein said recovering of said iodine radioisotopes fraction comprises washing of the alumina resin doped with silver with a solution of NaOH at a concentration of between 0.2 and 1.5 mol/l, between 0.3 and 1 mol/l, or about 0.5 mol/l, and eluting the iodine radioisotopes by a thiourea solution having a thiourea concentration of between 0.5 mol/l and 1.5 mol/l , between 0.8 and 1.2 mol/l, or of about 1 mol/l , collecting an eluate containing said iodine radioisotopes in a thiourea solution wherein the iodine radioisotope fraction is an iodine radioisotope fraction comprising I-131.

2. The method according to claim 1, wherein said uranium targets are low enriched uranium targets.

3. The method according to claim 2, further comprising, before said filtering, an addition of alkaline-earth nitrate selected from strontium nitrate, calcium nitrate, and barium nitrate, and sodium carbonate to said alkaline slurry.

4. The method according to claim 1, further comprising acidifying said eluate containing said iodine radioisotopes in a thiourea solution by the addition of a buffer solution, wherein the buffer solution comprises a solution of phosphoric acid with a concentration of between 0.5 and 2 mol/l, between 0.8 and 1.5 mol/l, or about 1 mol/l with a recovery of an acidified solution of iodine radioisotope salts.

5. The method according to claim 4, further comprising purifying said acidified solution of iodine radioisotope salts comprising loading said acidified solution of iodine radioisotope salts on an ion-exchange column, washing said ion-exchange resin with water, and eluting said ion-exchange resin with NaOH at a concentration of between 0.5 and 2.5 mol/l, between 0.8 mol/l and 1.5 mol/l or about 1 mol/l with a recovery of said iodine radioisotopes fraction in a solution of NaOH.

6. The method according to claim 5, wherein said ion-exchange resin is a weak anionic resin.

7. The method according to claim 1, further comprising an acidification of the alkaline solution of molybdate depleted of iodine radioisotopes comprising I-131, passing through said alumina resin doped with silver, with formation of an acid solution of molybdenum salts and release of residual iodine radioisotopes comprising I-131, in the form of gas for the purpose of the recovery thereof.

8. The method according to claim 7, further comprising, before said acidification of the alkaline molybdate solution depleted of iodine radioisotopes comprising I-131, passing through said alumina resin doped with silver, a cooling of the alkaline molybdate solution depleted of iodine radioisotopes, passing through said alumina resin doped with silver to a temperature below or equal to 60° C., below or equal to 55° C., or below or equal to 50° C.

9. The method according to claim 7, further comprising, after acidification, heating of the acid solution of molybdenum salts to a temperature greater than 93° C., greater or equal to 95° C., between 96° C. and 99° C., or below 100° C., accompanied by air bubbling.

10. The method according to claim 7, wherein said recovery of the iodine radioisotopes comprising I-131 as the release thereof is carried out by a transfer of the iodine radioisotopes comprising I-131 in the form of gas in a pipe connected at one end to an acidifier wherein the acidification occurs and at another end to a closed container containing an aqueous phase and a surrounding medium, said transfer of iodine radioisotopes comprising I-131 in the form of gas being carried out so as to result directly in the aqueous phase wherein the iodine radioisotopes comprising I-131, in the form of gas pass through the aqueous phase and escape in the form of bubbles in the surrounding medium of the aqueous phase, contained in the closed container.

11. The method according to claim 10, wherein said closed container is connected by a pipe to a second closed container that contains an NaOH trap and wherein the surrounding medium of the aqueous phase is transferred from the closed container to the second closed container containing the NaOH trap in the form of a solution at a concentration from 2 to 4 mol/l or about 3 mol/l , with discharge of the surrounding medium containing the iodine radioisotopes comprising I-131 of the pipe into the solution of the NaOH trap, with solubilisation of the iodine radioisotopes I-131 in the form of gas into iodide of iodine radioisotopes comprising I-131 in the aqueous solution of the NaOH trap.

12. The method according to claim 11, wherein the aqueous solution of the NaOH trap containing the iodides of the iodine radioisotopes comprising I-131, forms a crude iodine solution, which is then purified by a second acidification to form gaseous iodine.

13. The method according to claim 12, wherein said second acidification is carried out in the presence of $H_2SO_4$ and $H_2O_2$.

14. The method according to claim 12, wherein the gaseous iodine is captured in NaOH 0.2 M bubblers to form said fraction of iodine radioisotopes comprising I-131.

15. The method according to claim 5, wherein said fraction of iodine radioisotopes in an NaOH solution containing iodides of the iodine radioisotopes, forms a crude iodine solution and is then purified by a second acidification.

16. The method according to claim 15, wherein said second acidification is carried out in the presence of $H_2SO_4$ and $H_2O_2$.

17. The method according to claim 15, wherein the gaseous iodine is captured in NaOH 0.2 M bubblers to form said fraction of iodine radioisotopes comprising I-131.

18. The method according to claim 12, wherein said iodine radioisotopes fraction comprising I-131 in an NaOH solution and the aqueous solution of the NaOH trap containing the iodides of iodine radioisotopes comprising I-131, are collected and purified together by a second acidification.

* * * * *